US011476042B2

(12) United States Patent
Yoshinaka et al.

(10) Patent No.: US 11,476,042 B2
(45) Date of Patent: Oct. 18, 2022

(54) COIL COMPONENT

(71) Applicant: Murata Manufacturing Co., Ltd., Kyoto-fu (JP)

(72) Inventors: Keiichi Yoshinaka, Nagaokakyo (JP); Katsuhisa Imada, Nagaokakyo (JP); Ryohei Kawabata, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 607 days.

(21) Appl. No.: 16/373,552

(22) Filed: Apr. 2, 2019

(65) Prior Publication Data

US 2019/0311847 A1 Oct. 10, 2019

(30) Foreign Application Priority Data

Apr. 9, 2018 (JP) ..... JP2018-075076

(51) Int. Cl.

| | |
|---|---|
| ***H01F 5/00*** | (2006.01) |
| ***H01F 27/34*** | (2006.01) |
| ***H01F 27/28*** | (2006.01) |
| ***H01F 27/29*** | (2006.01) |
| ***H01F 41/04*** | (2006.01) |
| ***H01F 41/12*** | (2006.01) |
| ***H01F 27/32*** | (2006.01) |

(52) U.S. Cl.

CPC ..... *H01F 27/34* (2013.01); *H01F 27/2804* (2013.01); *H01F 27/29* (2013.01); *H01F 27/327* (2013.01); *H01F 41/041* (2013.01); *H01F 41/127* (2013.01); *H01F 2027/2809* (2013.01)

(58) Field of Classification Search

USPC ..... 336/200, 232

See application file for complete search history.

(56) References Cited

U.S. PATENT DOCUMENTS

| | | | | |
|---|---|---|---|---|
| 6,181,232 | B1 | 1/2001 | Kitamura | |
| 10,811,188 | B2 | 10/2020 | Xia et al. | |
| 2014/0065418 | A1* | 3/2014 | Kikuchi | H02K 3/30 428/383 |
| 2014/0191838 | A1* | 7/2014 | Yoshida | H01F 27/2804 336/200 |
| 2015/0116950 | A1 | 4/2015 | Yoo et al. | |
| 2015/0235765 | A1 | 8/2015 | Suzuki et al. | |

(Continued)

FOREIGN PATENT DOCUMENTS

| | | | |
|---|---|---|---|
| CN | 105940466 | A | 9/2016 |
| CN | 107452463 | A | 12/2017 |

(Continued)

OTHER PUBLICATIONS

English translation of JP56167303 (Year: 1981).*

(Continued)

*Primary Examiner* — Ronald Hinson

(74) *Attorney, Agent, or Firm* — Studebaker & Brackett PC

(57) ABSTRACT

A coil component including an element assembly that contains a filler and a resin material, a coil portion composed of a coil conductor that is embedded in the element assembly, and a pair of outer electrodes electrically connected to the coil conductor. The outer electrodes are disposed on a lower surface, and the coil axis of the coil portion is parallel to a mounting surface.

20 Claims, 7 Drawing Sheets

(56) References Cited

U.S. PATENT DOCUMENTS

| | | | | |
|---|---|---|---|---|
| 2015/0294780 | A1* | 10/2015 | Maeda | H01F 1/01 336/200 |
| 2016/0379746 | A1* | 12/2016 | Yoshioka | H01F 27/2823 336/220 |
| 2016/0379750 | A1 | 12/2016 | Hamada et al. | |
| 2017/0018351 | A1* | 1/2017 | Yatabe | H05K 3/3431 |
| 2017/0345558 | A1* | 11/2017 | Sekiguchi | H01F 27/29 |
| 2019/0146339 | A1 | 5/2019 | Kondo | |

FOREIGN PATENT DOCUMENTS

| | | | |
|---|---|---|---|
| JP | H05-121240 | A | 5/1993 |
| JP | H08-088126 | A | 4/1996 |
| JP | H11-54326 | A | 2/1999 |
| JP | 2001-093733 | A | 4/2001 |
| JP | 2007-027354 | A | 2/2007 |
| JP | 2014-139981 | A | 7/2014 |
| JP | 2015-088753 | A | 5/2015 |
| JP | 2015-156432 | A | 8/2015 |
| JP | 2016-201466 | A | 12/2016 |
| JP | 2017-011185 | A | 1/2017 |
| JP | 2017-073536 | A | 4/2017 |
| JP | 2017-216428 | A | 12/2017 |
| WO | 2014/061670 | A1 | 4/2014 |
| WO | 2018/016480 | A1 | 1/2018 |

OTHER PUBLICATIONS

An Office Action; "Notification of Reasons for Refusal," mailed by the Japanese Patent Office dated Aug. 4, 2020, which corresponds to Japanese Patent Application No. 2018-075076 and is related to U.S. Appl. No. 16/373,552 with English language translation.

An Office Action; "Notice of Reasons for Refusal," mailed by the Japanese Patent Office dated Jul. 27, 2021, which corresponds to Japanese Patent Application No. 2018-240084 and is related to U.S. Appl. No. 16/373,552 with with English translation.

An Office Action; "Decision of Refusal," mailed by the Japanese Patent Office dated Feb. 15, 2022, which corresponds to Japanese Patent Application No. 2018-240084 and is related to U.S. Appl. No. 16/373,552 with English language translation.

* cited by examiner

COIL COMPONENT

CROSS-REFERENCE TO RELATED APPLICATION

This application claims benefit of priority to Japanese Patent Application No. 2018-075076, filed Apr. 9, 2018, the entire content of which is incorporated herein by reference.

BACKGROUND

Technical Field

The present disclosure relates to a coil component.

Background Art

Regarding a coil component in which a coil conductor is embedded in an element assembly portion, a coil component in which an α-winding coil is embedded in an element assembly composed of a composite material containing metal particles and a resin material is known, as described in Japanese Unexamined Patent Application Publication No. 2016-201466.

The coil component that includes the composite material containing the resin material is produced by preparing a composite material sheet containing the resin material, placing a coil thereon, further placing another composite material sheet from above the coil, and performing compression molding. In the coil component described in Japanese Unexamined Patent Application Publication No. 2016-201466, outer electrodes are located on both end surfaces of the coil component. Therefore, insulation between adjacent components has to be ensured, and high-density mounting is difficult. In addition, there is a problem in that stray capacitance between the outer electrode and the coil conductor increases.

SUMMARY

Accordingly, the present disclosure provides a coil component in which a coil portion is embedded in an element assembly containing a resin material, which can be surface-mounted at a high density, and which has a reduced stray capacitance.

According to preferred embodiments of the present disclosure, the following aspects are included.

(1) A coil component including an element assembly that contains a filler and a resin material, a coil portion composed of a coil conductor that is embedded in the element assembly, and a pair of outer electrodes electrically connected to the coil conductor. The outer electrodes are disposed on a lower surface, and the coil axis of the coil portion is parallel to a mounting surface.

(2) The coil component according to (1) described above, wherein the coil portion has extension portions, and the extension portions extend from a winding portion of the coil portion toward the outer electrodes and are electrically connected to the outer electrodes.

(3) The coil component according to (2) described above, wherein the width of each of the extension portions is about 1.0 or more times and 6.0 or less times (i.e., from about 1.0 time to 6.0 times) the width of the winding portion.

(4) The coil component according to any one of (1) to (3) described above, wherein the thickness of the coil conductor is about 3 μm or more and 200 μm or less (i.e., from about 3 μm to 200 μm).

(5) The coil component according to any one of (2) to (4) described above, wherein the width of each of the extension portions is about 50 μm or more and 350 μm or less (i.e., from about 50 μm to 350 μm).

(6) The coil component according to any one of (1) to (5) described above, wherein the coil conductor is covered with a glass layer.

(7) The coil component according to (6) described above, wherein the thickness of the glass layer is about 3 μm or more and 30 μm or less (i.e., from about 3 μm to 30 μm).

(8) The coil component according to any one of (1) to (7) described above, wherein the length is about 0.3 mm or more and 2.2 mm or less (i.e., from about 0.3 mm to 2.2 mm) and the width is about 0.1 mm or more and 1.5 mm or less (i.e., from about 0.1 mm to 1.5 mm).

Other features, elements, characteristics and advantages of the present disclosure will become more apparent from the following detailed description of preferred embodiments of the present disclosure with reference to the attached drawings.

DETAILED DESCRIPTION

The coil component according to preferred embodiments of the present disclosure will be described below with reference to the drawings. In this regard, the shapes, arrangements, and the like of the coil component and constituent elements of the present embodiment are not limited to the examples illustrated.

Figure 1:
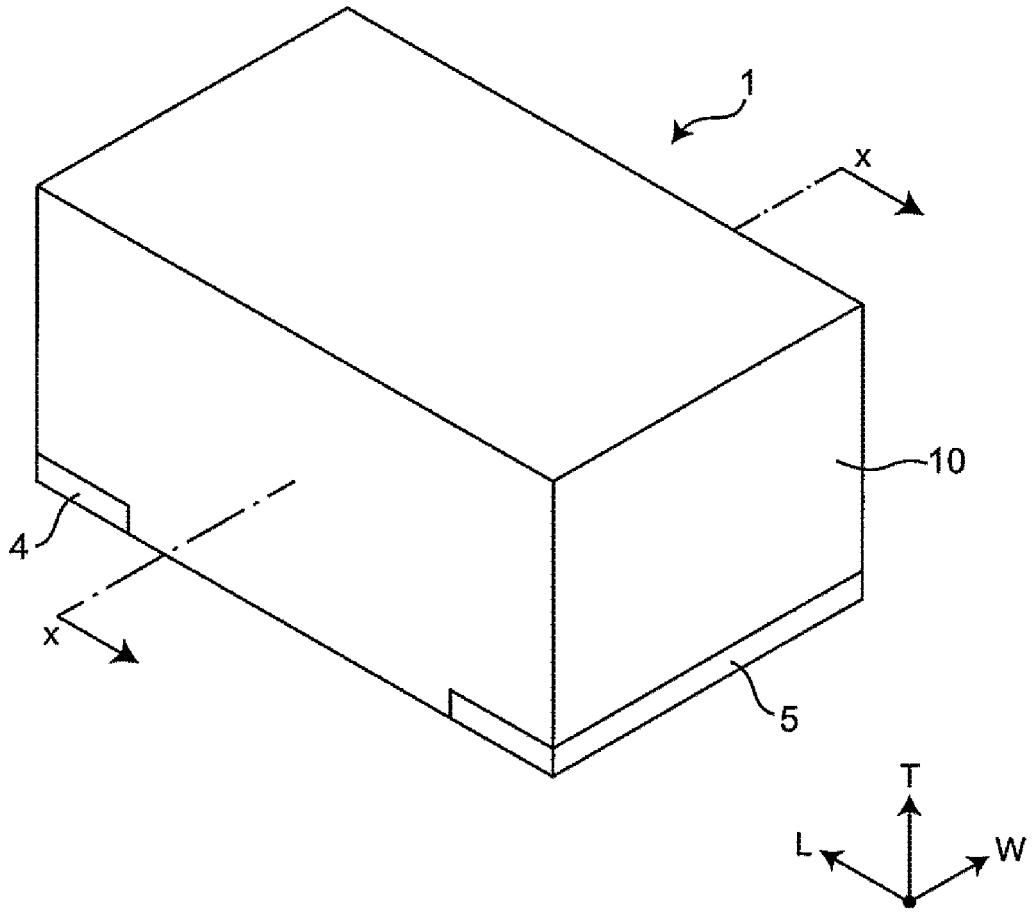
FIG. 1 is a perspective view of a coil component according to a first embodiment of the present disclosure.
Figure 2:
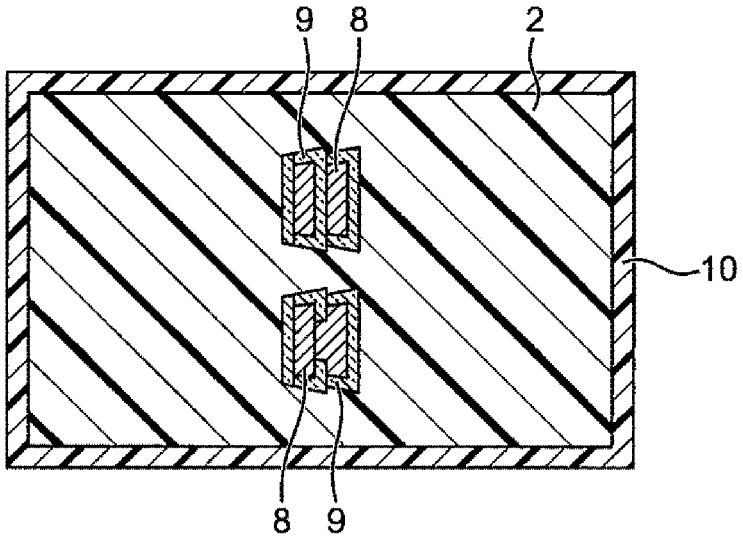
FIG. 2 is a sectional view of the section of the coil component along line X-X in FIG. 1.
Figure 3:
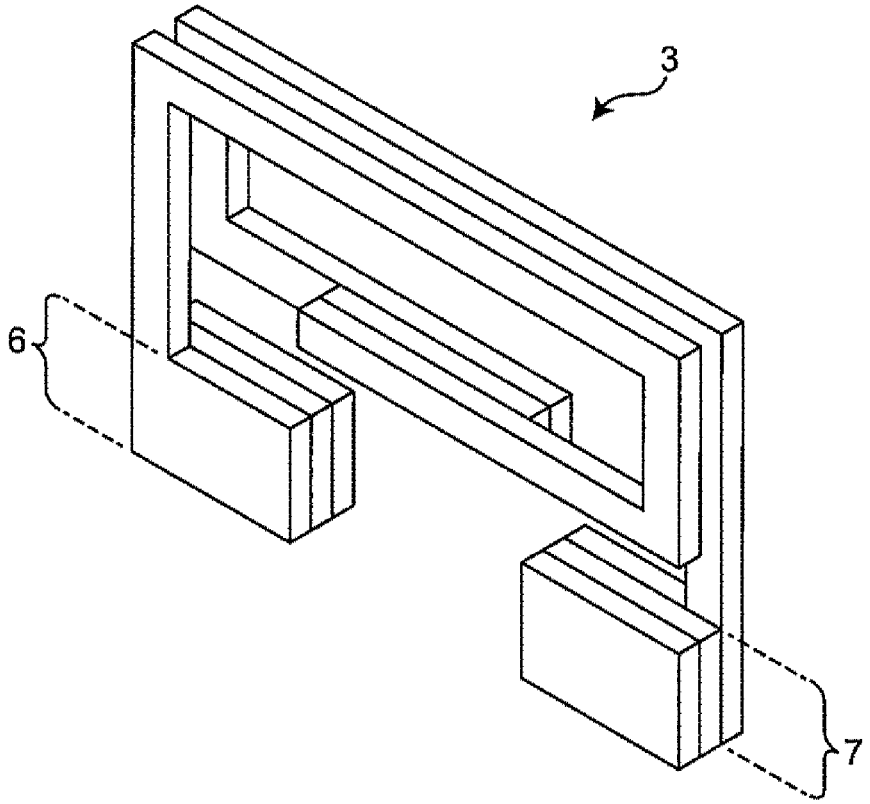
FIG. 3 is a perspective view of a coil portion of the coil component in FIG. 1.

FIG. 1 is a perspective view of the coil component 1 according to the present embodiment, and FIG. 2 is a schematic sectional view thereof. FIG. 3 is a schematic perspective view of a coil portion 3 of the coil component 1. In this regard, the shapes, arrangements, and the like of the coil component and constituent elements of the embodiment described below are not limited to the examples illustrated.

As shown in FIG. 1 to FIG. 3, the coil component 1 according to the present embodiment is in the shape of a substantially rectangular parallelepiped. In the coil component 1, the surfaces in the right and left portions of FIG. 2 are denoted as "end surfaces", the surface in the upper portion of FIG. 2 is denoted as an "upper surface", the surface in the lower portion of FIG. 2 is denoted as a "lower surface", the surface in the near portion of FIG. 2 is denoted as a "front surface", and the surface in the far portion of FIG. 2 is denoted as a "back surface". Briefly, the coil component 1 includes an element assembly 2, the coil portion 3 embedded in the element assembly 2, and a pair of outer electrodes 4 and 5. The coil portion 3 has an axis that extends in front-surface and back-surface directions of the element assembly 2, that is, an axis parallel to a mounting surface. As shown in FIG. 3, the coil portion 3 has extension portions 6 and 7, which are electrically connected to the outer electrodes 4 and 5, respectively. As shown in FIG. 2, a coil conductor 8 of the coil portion 3 is covered with a glass layer 9. Meanwhile, the coil component 1 except the outer electrodes 4 and 5 is covered with an insulating layer 10.

In the present specification, the length of the coil component 1 is denoted as "L", the width is denoted as "W", and the thickness (height) is denoted as "T" (refer to FIG. 1). In the present specification, the surface parallel to the front surface and the back surface is denoted as the "LT surface", the surface parallel to the end surface is denoted as the "WT surface", and the surface parallel to the upper surface and the lower surface is denoted as the "LW surface".

The element assembly 2 is composed of a composite material containing a filler and a resin material. There is no particular limitation regarding the resin material. Examples of the resin material include thermosetting resins, for example, an epoxy resin, a phenol resin, a polyester resin, a polyimide resin, and a polyolefin resin. One type of the resin material may be used alone, or at least two types may be used.

The filler is preferably metal particles, ferrite particles, or glass particles and more preferably metal particles. One type of the filler may be used alone, or a plurality of types may be used in combination.

According to an aspect, the filler has an average particle diameter of preferably about 0.5 μm or more and 30 μm or less (i.e., from about 0.5 μm to 30 μm) and more preferably about 0.5 μm or more and 10 μm or less (i.e., from about 0.5 μm to 10 μm). When the average particle diameter of the filler is about 0.5 μm or more, the filler is readily handled. Meanwhile, setting the average particle diameter of the filler to be about 30 μm or less enables the filling ratio of the filler to be increased and enables the characteristics of the filler to be more effectively obtained. For example, in the case in which the filler is metal particles, the magnetic characteristics are improved.

The average particle diameter is calculated from the equivalent circle diameter of the filler in a scanning electron microscope (SEM) image of the cross section of the element assembly. For example, the average particle diameter can be obtained by taking SEM photographs of a plurality of (for example, five) regions (for example, 130 μm×100 μm) in a cross section obtained by cutting the coil component 1, analyzing the resulting SEM images by using image analysis software (for example, Azokun (registered trademark) produced by Asahi Kasei Engineering Corporation) so as to determine the equivalent circle diameter of 500 or more of metal particles, and calculating the average thereof.

There is no particular limitation regarding the metal material that constitutes the metal particles. Examples of the metal material include iron, cobalt, nickel, and gadolinium and an alloy of at least one of these. Preferably, the metal material is iron or an iron alloy. Iron may be iron only or an iron derivative, for example, a complex. There is no particular limitation regarding such an iron derivative, and examples of the iron derivative include iron carbonyl, which is a complex of iron and CO, preferably iron pentacarbonyl. In particular, a hard-grade iron carbonyl (for example, a hard-grade iron carbonyl produced by BASF) having an onion skin structure (structure in which concentric-sphere-shaped layers are formed around the center of a particle) is preferable. There is no particular limitation regarding the iron alloy, and examples of the iron alloy include Fe—Si-based alloys, Fe—Si—Cr-based alloys, Fe—Si—Al-based alloys, Ne—Ni-based alloys, Fe—Co-based alloys, and Fe—Si—B—Nb—Cu-based alloys. The above-described alloys may further contain B, C, and the like as other secondary components. There is no particular limitation regarding the content of the secondary component, and the content may be, for example, about 0.1% by weight or more and 5.0% by weight or less (i.e., from about 0.1% by weight to 5.0% by weight) and preferably about 0.5% by weight or more and 3.0% by weight or less (i.e., from about 0.5% by weight to 3.0% by weight). One type of the metal material may be used alone, or at least two types may be used.

The surfaces of the metal particles may be covered with a coating of an insulating material (hereafter also referred to simply as an "insulating coating"). The specific resistance of the inside of the element assembly can be increased by covering the surfaces of the metal particles with the insulating coating.

The surface of each metal particle may be covered with the insulating coating to the extent that the insulation performance between the particles can be enhanced, and part of the surface of each metal particle may be covered with the insulating coating. There is no particular limitation regarding the form of the insulating coating, and the form of a network or a layer may be adopted. In a preferred aspect, regarding each of the metal particles, the region corresponding to about 30% or more, preferably about 60% or more, more preferably about 80% or more, further preferably about 90% or more, and particularly preferably 100% of the surface may be covered with the insulating coating.

There is no particular limitation regarding the thickness of the insulating coating. The thickness is preferably about 1 nm or more and 100 nm or less (i.e., from about 1 nm to 100 nm), more preferably about 3 nm or more and 50 nm or less (i.e., from about 3 nm to 50 nm), and further preferably about 5 nm or more and 30 nm or less (i.e., from about 5 nm to 50 nm), and may be, for example, about 10 nm or more and 30 nm or less (i.e., from about 10 nm to 30 nm) or about 5 nm or more and 20 nm or less (i.e., from about 5 nm to 20 nm). The specific resistance of the element assembly can be increased by increasing the thickness of the insulating coating. In addition, decreasing the thickness of the insulating coating enables the amount of the metal material in the element assembly to be increased, which improves the magnetic characteristics of the element assembly, readily realizing a size reduction of the coil component.

According to an aspect, the insulating coating is formed of an insulating material containing Si. Examples of the insulating material containing Si include silicon-based compounds, for example, $SiO_x$ (x is about 1.5 or more and 2.5 or less (i.e., from about 1.5 to 2.5), and $SiO_x$ is typically $SiO_2$). According to an aspect, the insulating coating is an oxide film formed by oxidizing the surface of the metal particle.

There is no particular limitation regarding the method for applying the insulating coating, and a coating method known to a person skilled in the art, for example, a sol-gel method, a mechanochemical method, a spray drying method, a fluidized-bed granulation method, an atomization method, and a barrel sputtering method, may be used. There is no particular limitation regarding the ferrite material constituting the ferrite particles, and examples include a ferrite material containing Fe, Zn, Cu, and Ni as primary components.

According to an aspect, the ferrite particles may be covered with the insulating coating in the same manner as the metal particles. The specific resistance of the inside of the element assembly can be increased by covering the surfaces of the ferrite particles with the insulating coating. There is no particular limitation regarding the glass material constituting the glass particles, and examples include Bi—B—O-based glass, V—P—O-based glass, Sn—P—O-based glass, and V—Te—O-based glass.

As shown in FIG. 2 and FIG. 3, in the coil component 1 according to the present embodiment, the two ends of the coil portion 3 are set to extend downward in the element assembly 2 by using the extension portions 6 and 7 and are exposed at the lower surface of the element assembly 2. The axis of the coil portion 3 is parallel to the mounting surface, that is, the axis of the coil portion 3 extends in the direction from the front surface of the element assembly 2 toward the back surface (i.e., W-direction). Setting the axis of the coil portion to be parallel to the mounting surface enables the extension portion that is formed in the lateral direction of a winding portion to be reduced, or there is no need to form an extension portion in the lateral direction of the winding portion. In other words, a region in which the winding portion overlaps the extension portion can be reduced or such a region can be eliminated in plan view. Therefore, stray capacitance generated between the winding portion and the outer electrode can be decreased. In addition, the L-value acquisition efficiency can be increased because the diameter of the winding can be increased. Meanwhile, the number of turns of the coil portion 3 of the coil component 1 is about 1.5. However, there is no particular limitation regarding the number of turns of the coil component according to the present disclosure, and the number of turns may be appropriately selected in accordance with the purpose.

In the coil component 1, coil conductors 8 constituting the coil portion 3 are stacked in the W-direction. Therefore, the cross section of the coil conductor 8 constituting the coil portion 3 is longer in the T-direction than in the L-direction. Stray capacitance between the coil portion 3 and the outer electrodes 4 and 5 can be decreased by the coil conductor 8 having the above-described form.

There is no particular limitation regarding a conductive material constituting the coil conductor 8, and examples of the conductive material include gold, silver, copper, palladium, and nickel. The conductive material is preferably silver or copper and more preferably silver. One type of the conductive material may be used alone, or at least two types may be used.

The thickness of the coil conductor 8 (thickness in the lateral direction in FIG. 2) is preferably about 3 μm or more and 200 μm or less (i.e., from about 3 μm to 200 μm), more preferably about 5 μm or more and 100 μm or less (i.e., from about 5 μm to 100 μm), and further preferably about 10 μm or more and 100 μm or less (i.e., from about 10 μm to 100 μm). The resistance of the coil conductor 8 can be reduced by increasing the thickness of the coil conductor. Meanwhile, size reduction of the coil component is facilitated by decreasing the thickness of the coil conductor 8.

The width of the coil conductor 8 (width in the vertical direction in FIG. 2) is preferably about 5 μm or more and 1 mm or less (i.e., from about 5 μm to 1 mm), more preferably about 10 μm or more and 500 μm or less (i.e., from about 10 μm to 500 μm), further preferably about 15 μm or more and 300 μm or less (i.e., from about 15 μm to 300 μm), and still more preferably 20 μm or more and 100 μm or less (i.e., from about 20 μm to 100 μm). The coil conductor can be reduced in size by decreasing the width of the coil conductor, and there are advantages in size reduction of the coil component. Meanwhile, the resistance of the conducting wire can be reduced by increasing the width of the coil conductor.

The coil portion 3 has extension portions 6 and 7. The extension portions 6 and 7 extend from the winding portion of the coil portion toward the outer electrodes and are electrically connected to the outer electrodes 4 and 5, respectively. The width of the extension portions is preferably about 1.0 or more times and 6.0 or less times (i.e., from about 1.0 times to 6.0 times), more preferably more than about 1.0 times and 6.0 or less times (i.e., from more than about 1.0 times to 6.0 times), further preferably about 1.5 or more times and 5.0 or less times (i.e., from about 1.5 times to 5.0 times), and still more preferably 2.0 or more times and 4.0 or less times (i.e., from 2.0 times to 4.0 times) the width of the winding portion. The width of the extension portion is the width of the portion in contact with the outer electrode and is denoted as the width in the L-direction in the present embodiment. When the width of the extension portion is set to be 1.0 or more times the width of the coil conductor, particularly more than the width of the coil conductor, the extension portion is more reliably connected to the outer electrode, and reliability is improved.

In the coil component according to the present disclosure, the coil conductor 8 may be covered with a glass layer 9. There is no particular limitation regarding a glass material constituting the glass layer 9. Examples of the glass material include $SiO_2$—$B_2O_3$-based glass, $SiO_2$—$B_2O_3$—$K_2O$-based glass, $SiO_2$—$B_2O_3$—$Li_2O$—CaO-based glass, $SiO_2$—$B_2O_3$—$Li_2O$—CaO—ZnO-based glass, and $Bi_2O_3$—$B_2O_3$—$SiO_2$—$Al_2O_3$-based glass. In a preferred aspect, the glass material is $SiO_2$—$B_2O_3$—$K_2O$-based glass. When the $SiO_2$—$B_2O_3$—$K_2O$-based glass is used, the sinterability during formation of the glass layer is enhanced.

According to an aspect, the glass layer 9 may further contain a filler. Examples of the filler contained in the glass layer include quartz, alumina, magnesia, silica, forsterite, steatite, and zirconia.

The thickness of the glass layer 9 is preferably about 3 μm or more and 30 μm or less (i.e., from about 3 μm to 30 μm) and more preferably about 5 μm or more and 20 μm or less (i.e., from about 5 μm to 20 μm). Setting the thickness of the glass layer 9 to be about 3 μm or more enables the coil portion to be more firmly supported and enables the insulating performance between the coil portion and the element assembly to be enhanced. Setting the thickness of the glass layer 9 to be about 30 μm or less enables the coil component to be reduced in size.

The outer electrodes 4 and 5 are disposed on the lower surface of the coil component 1. The coil component 1 can be surface-mounted at a high density by disposing the outer electrodes on the lower surface. In addition, stray capacitance is reduced compared with the case in which the outer electrodes are disposed on the side surfaces.

The outer electrodes 4 and 5 are disposed on the extension portions 6 and 7, respectively, of the coil portion 3 that extend to the lower surface of the element assembly 2. That is, the outer electrodes 4 and 5 are electrically connected to the extension portions 6 and 7, respectively, of the coil portion 3.

According to an aspect, the outer electrodes 4 and 5 may be not only disposed on the extension portions 6 and 7, respectively, of the coil portion 3 that extend to the lower surface of the element assembly 2 but may also extend beyond the end portions of the coil conductor to the other portions of the lower surface of the coil component.

According to an aspect, the outer electrodes 4 and 5 are disposed in the region in which the insulating layer 10 is not provided, that is, in the entire region at which the element assembly 2 and the coil portion 3 are exposed. According to an aspect, the outer electrodes 4 and 5 may extend to the end surfaces of the coil component.

There is no particular limitation regarding the thickness of the outer electrode, and the thickness may be, for example, about 1 μm or more and 100 μm or less (i.e., from about 1 μm to 100 μm), preferably about 5 μm or more and 50 μm or less (i.e., from about 5 μm to 50 μm), and more preferably about 5 μm or more and 20 μm or less (i.e., from about 5 μm to 20 μm).

The outer electrode is composed of a conductive material, preferably at least one metal material selected from a group consisting of Au, Ag, Pd, Ni, Sn, and Cu. Preferably, the outer electrode is formed by plating. The outer electrode may be a single layer or a multilayer.

According to an aspect, the outer electrode is a multilayer. Preferably, the outer electrode may be composed of three layers consisting of a Cu layer, a Ni layer, and a Sn layer, or two layers consisting of a Ni layer and a Sn layer. The adhesiveness of the plating to the element assembly can be enhanced by forming a Cu layer on the element assembly 2.

The coil component 1 except the outer electrodes 4 and 5 is covered with an insulating layer 10. There is no particular limitation regarding the thickness of the insulating layer 10, and the thickness is preferably about 3 μm or more and 20 μm or less (i.e., from about 3 μm to 20 μm), more preferably about 3 μm or more and 10 μm or less (i.e., from about 3 μm to 10 μm), and further preferably about 3 μm or more and 8 μm or less (i.e., from about 3 μm to 8 μm). Setting the thickness of the insulating layer to be within the above-described range enables an increase in size of the coil component 1 to be suppressed and, in addition, enables the insulation performance of the surface of the coil component 1 to be ensured.

Examples of the insulating material constituting the insulating layer 10 include resin materials having high electric insulation performance such as an acrylic resin, an epoxy resin, and a polyimide resin. In the coil component according to the present disclosure, the insulating layer 10 is not indispensable and may be omitted.

The coil component according to the present disclosure can be reduced in size while having excellent electric characteristics. According to an aspect, the length (L) of the coil component according to the present disclosure is preferably about 0.38 mm or more and 1.75 mm or less (i.e., from about 0.38 mm to 1.75 mm) and more preferably about 0.38 mm or more and 1.05 mm or less (i.e., from about 0.38 mm to 1.05 mm). According to an aspect, the width (W) of the coil component according to the present disclosure is preferably about 0.18 mm or more and 0.95 mm or less (i.e., from about 0.18 mm to 0.95 mm) and more preferably about 0.18 mm or more and 0.55 mm or less (i.e., from about 0.18 mm to 0.55 mm). In a preferred aspect, regarding the coil component according to the present disclosure, the length (L) may be about 1.0 mm and the width (W) may be about 0.5 mm Preferably, the length (L) may be about 0.6 mm and the width (W) may be about 0.3 mm More preferably, the length (L) may be about 0.4 mm and the width (W) may be about 0.2 mm According to an aspect, the height (or thickness (T)) of the coil component according to the present disclosure is preferably about 0.95 mm or less and more preferably about 0.55 mm or less.

Next, a method for manufacturing the coil component 1 will be described.

Production of Magnetic Sheet (Element Assembly Sheet)

Metal particles (filler) and a resin material are prepared. The metal particles and other filler components (a glass powder, a ceramic powder, a ferrite powder, and the like), as the situation demands, are wet-mixed with the resin material so as to form a slurry, a sheet having a predetermined thickness is formed by using a doctor blade method or the like, and drying is performed. In this manner, a magnetic sheet of a composite material of the metal particles and the resin material is produced.

Photosensitive Conductor Paste

Conductive particles, for example, a Ag powder is prepared. A predetermined amount of the conductive particles are mixed with a varnish prepared by mixing a solvent and an organic component so as to produce a photosensitive conductor paste.

Photosensitive Glass Paste

A glass powder is prepared. A predetermined amount of the glass powder is mixed with a varnish prepared by mixing a solvent and an organic component so as to produce a photosensitive glass paste.

Shape-Retaining Photosensitive Paste

A material that disappears at a firing stage and, as the situation demands, an inorganic material powder that does not sinter at a firing stage are prepared. Examples of the material that disappears at a firing stage include an organic material, preferably the above-described varnish. Examples of the above-described inorganic material include a ceramic powder, for example, alumina. The D50 of the inorganic material is preferably about 0.1 μm or more and 10 μm or less (i.e., from about 0.1 μm to 10 μm). A predetermined amount of the inorganic material powder that does not sinter at a firing stage is mixed with a varnish prepared by mixing a solvent and an organic component so as to produce a shape-retaining photosensitive paste.

Production of Element

Figure 4A:
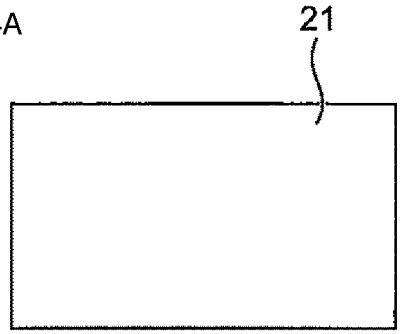
FIGS. 4A to 4F are diagrams illustrating the method for manufacturing the coil component in the first embodiment.

A sintered ceramic substrate 21 is prepared as a substrate (FIG. 4A).

Figure 4B:
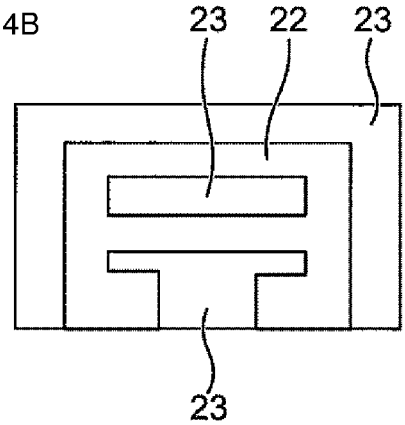

A glass paste layer 22 is formed of the photosensitive glass paste on the substrate 21 by using a photolithography method. Specifically, the glass paste layer 22 is formed by applying the photosensitive glass paste, performing photo-curing through a mask, and performing development (FIG. 4B). Subsequently, a shape-retaining paste layer 23 is formed of the shape-retaining photosensitive paste in the periphery of the glass paste layer 22 by using the photolithography method. Specifically, the shape-retaining paste layer 23 is formed in the periphery of the glass paste layer 22 by applying the shape-retaining photosensitive paste, performing photo-curing through a mask, and performing development (FIG. 4B). As the situation demands, the glass paste layer 22 and the shape-retaining paste layer 23 having predetermined thicknesses may be formed by repeating this procedure.

Figure 4C:
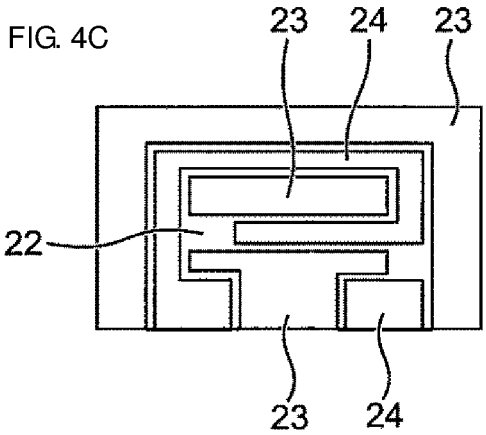

A conductor paste layer 24 is formed on the glass paste layer 22 by using the photolithography method. Specifically, the conductor paste layer 24 is formed by applying the photosensitive conductor paste, performing photo-curing through a mask, and performing development (FIG. 4C). The conductor paste layer 24 is formed inside the glass paste layer 22 formed in advance.

Figure 4D:
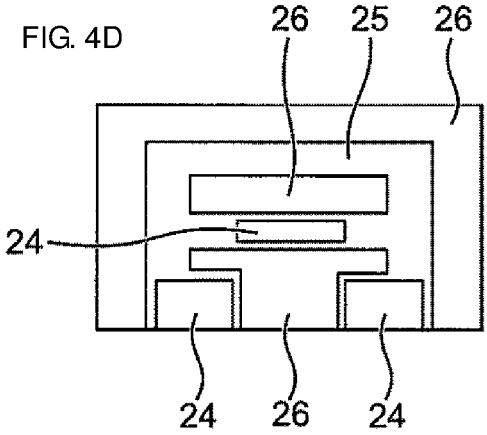

A glass paste layer 25 is formed on the conductor paste layer 24 by using the photolithography method. Specifically, the glass paste layer 25 is formed so as to cover the conductor paste layer 24 by applying the photosensitive glass paste, performing photo-curing through a mask, and performing development (FIG. 4D). At this time, the glass paste layer 25 is formed in the regions of the conductor paste layer 24 so as to expose the regions serving as the extension portions and the region serving as a connection portion to a conductor paste layer 27 to be formed thereafter. Next, a shape-retaining paste layer 26 is formed of the shape-retaining photosensitive paste in the periphery of the glass paste layer 25 by using the photolithography method. Specifically, the shape-retaining paste layer 26 is formed in the periphery of the glass paste layer 25 by applying the shape-retaining photosensitive paste, performing photo-curing through a mask, and performing development (FIG. 4D). As the situation demands, the glass paste layer 25 and the shape-retaining paste layer 26 having predetermined thicknesses may be formed by repeating this procedure.

Figure 4E:
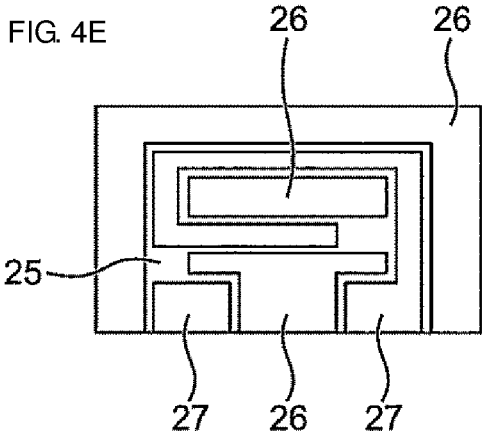

A conductor paste layer 27 is formed on the glass paste layer 25 by using the photolithography method. Specifically, the conductor paste layer 27 is formed by applying the photosensitive conductor paste, performing photo-curing through a mask, and performing development (FIG. 4E). The conductor paste layer 27 is formed inside the glass paste layer 25 formed in advance.

Figure 4F:
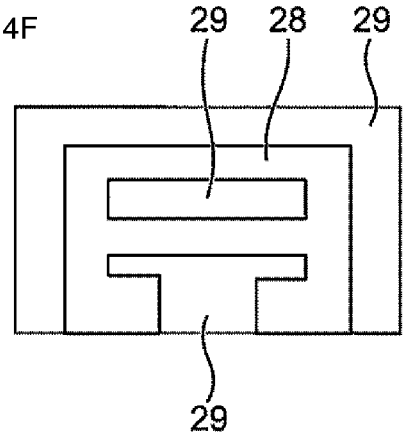

A glass paste layer 28 is formed on the conductor paste layer 27 by using the photolithography method. Specifically, the glass paste layer 28 is formed so as to cover the conductor paste layer 27 by applying the photosensitive glass paste, performing photo-curing through a mask, and performing development (FIG. 4F). Next, a shape-retaining paste layer 29 is formed of the shape-retaining photosensitive paste in the periphery of the glass paste layer 28 by using the photolithography method. Specifically, the shape-retaining paste layer 29 is formed in the periphery of the glass paste layer 28 by applying the shape-retaining photosensitive paste, performing photo-curing through a mask, and performing development (FIG. 4F). As the situation demands, the glass paste layer 28 and the shape-retaining paste layer 29 having predetermined thicknesses may be formed by repeating this procedure.

A multilayer body is formed on the substrate as described above.

Figure 5A:
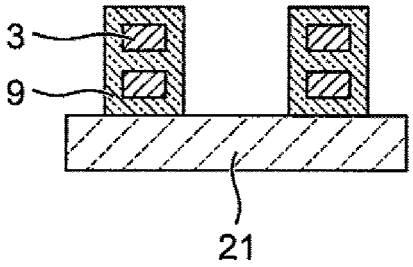
FIGS. 5A to 5D are diagrams illustrating the method for manufacturing the coil component in the first embodiment.

The resulting multilayer body is fired at a temperature of 650° C. to 950° C. The organic material in the shape-retaining paste layer disappears during firing, and the inorganic material that does not sinter, for example, alumina, remains as powder without sintering. The coil portion 3 covered with the glass layer 9 is obtained on the substrate by removing the inorganic material powder (FIG. 5A). The coil portion 3 covered with the glass layer 9 is in close contact with the substrate 21 and, therefore, there are advantages in handling, for example, transportation.

Figure 5B:
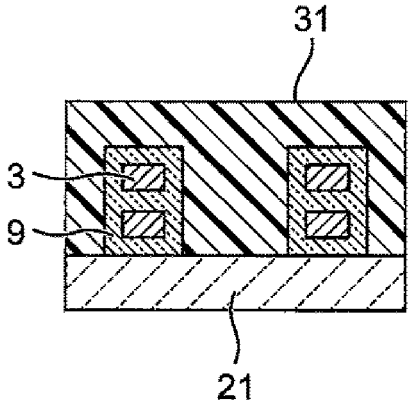

The magnetic sheet is pressed into the coil portion 3. A magnetic sheet 31 is placed on the coil portion 3 and pressurized by a die or the like so as to make it possible to be pressed into the coil portion 3 (FIG. 5B).

Figure 5C:
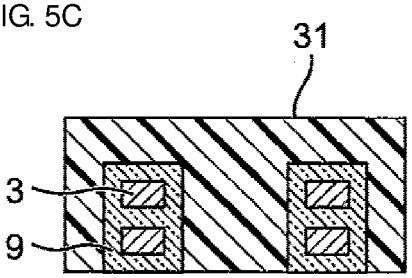

The substrate 21 is removed by grinding or the like (FIG. 5C).

Figure 5D:
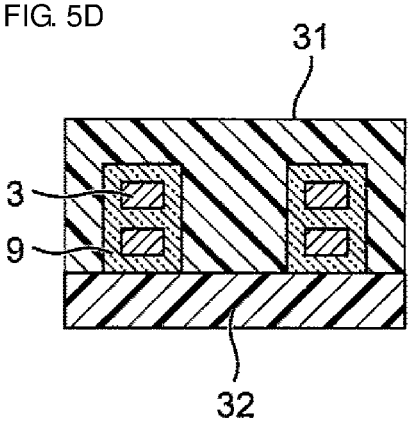

Another magnetic sheet is made to come into close contact with the surface, from which the substrate 21 has been removed, by pressing or the like (FIG. 5D). Thereafter, cutting is performed by a dicer or the like so as to separate the individual element assemblies from each other.

An insulating film 10 is formed on the entire surface of the resulting element assembly 2. The insulating film may be formed by using a known method. For example, a method in which the element surface is covered by spraying an insulating material or a method in which dipping into an insulating material is performed may be used.

Figure 6A:
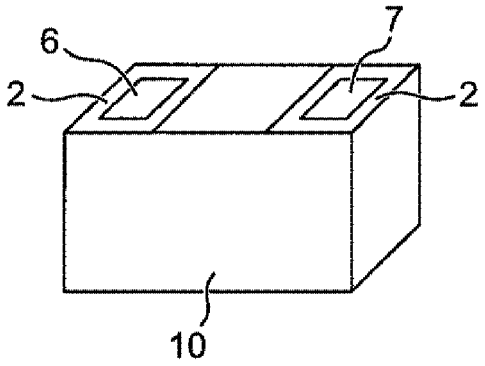
FIGS. 6A to 6C are diagrams illustrating the method for manufacturing the coil component in the first embodiment.

The insulating film 10 is removed from regions, in which the outer electrodes are to be formed, of the element assembly 2. Removal may be performed by laser irradiation or a mechanical technique (FIG. 6A).

Figure 6B:
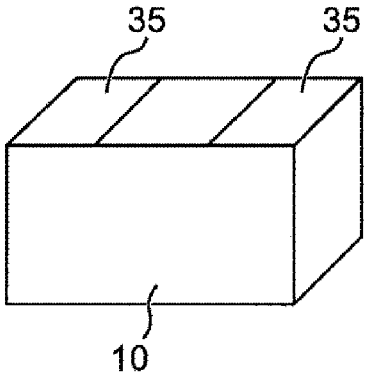
Figure 6C:
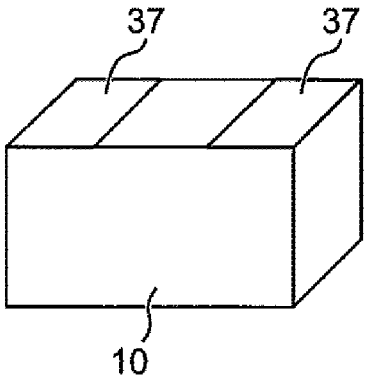

A Cu layer 35 is formed (FIG. 6B). Forming the Cu layer enables outer electrodes to be smoothly formed on even an element assembly having low electrical conductivity. Subsequently, a Ni layer and a Sn layer are sequentially formed by plating (FIG. 6C).

In this manner, the coil component 1 according to an embodiment of the present disclosure is produced.

In the coil component 1, the number of turns of the coil portion 3 is 1.5. However, there is no particular limitation regarding the number of turns of the coil component according to the present disclosure. For example, a coil component having the number of turns of 2.5 may be produced by performing the steps shown in FIGS. 7A to 7D, as described below, between the step shown in FIG. 4D and the step shown in FIG. 4E.

Figure 7A:
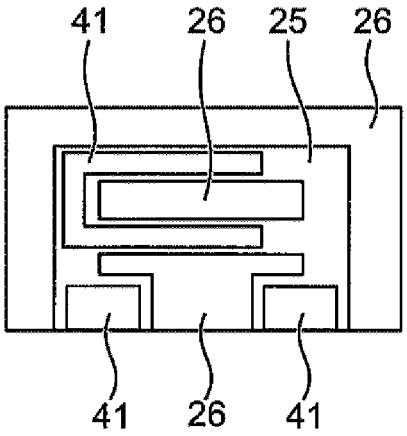
FIGS. 7A to 7D are diagrams illustrating the method for manufacturing a coil component in a second embodiment.

After the step shown in FIG. 4D, a conductor paste layer 41 is formed on the glass paste layer 25 by using the photolithography method. Specifically, the conductor paste layer 41 is formed by applying the photosensitive conductor paste, performing photo-curing through a mask, and performing development (FIG. 7A). The conductor paste layer 41 is formed inside the glass paste layer 25 formed in advance.

Figure 7B:
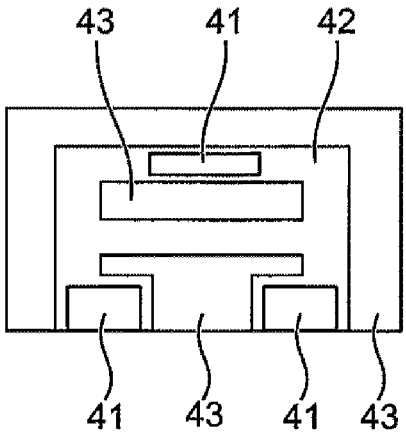
Figure 7C:
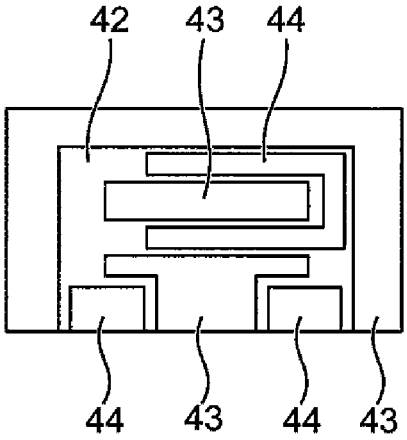

A glass paste layer 42 is formed on the conductor paste layer 41 by using the photolithography method. Specifically, the glass paste layer 42 is formed so as to cover the conductor paste layer 41 by applying the photosensitive glass paste, performing photo-curing through a mask, and performing development (FIG. 7B). At this time, the glass paste layer 42 is formed in the regions of the conductor paste layer 41 so as to expose the regions serving as the extension portions and the region serving as a connection portion to a conductor paste layer 44 to be formed thereafter. Next, a shape-retaining paste layer 43 is formed of the shape-retaining photosensitive paste in the periphery of the glass paste layer 42 by using the photolithography method. Specifically, the shape-retaining paste layer 43 is formed in the periphery of the glass paste layer 42 by applying the shape-retaining photosensitive paste, performing photo-curing through a mask, and performing development (FIG. 7B). As the situation demands, the glass paste layer 42 and the shape-retaining paste layer 43 having predetermined thicknesses may be formed by repeating this procedure.

Figure 7D:
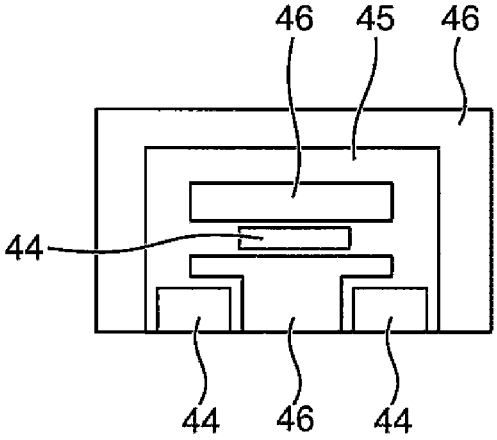
Figure 8:
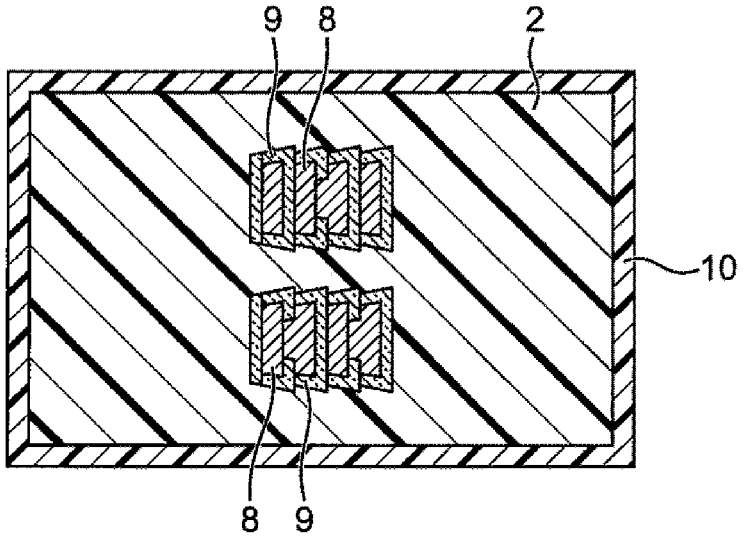
FIG. 8 is a sectional view of the section of the coil component in the second embodiment.
Figure 9:
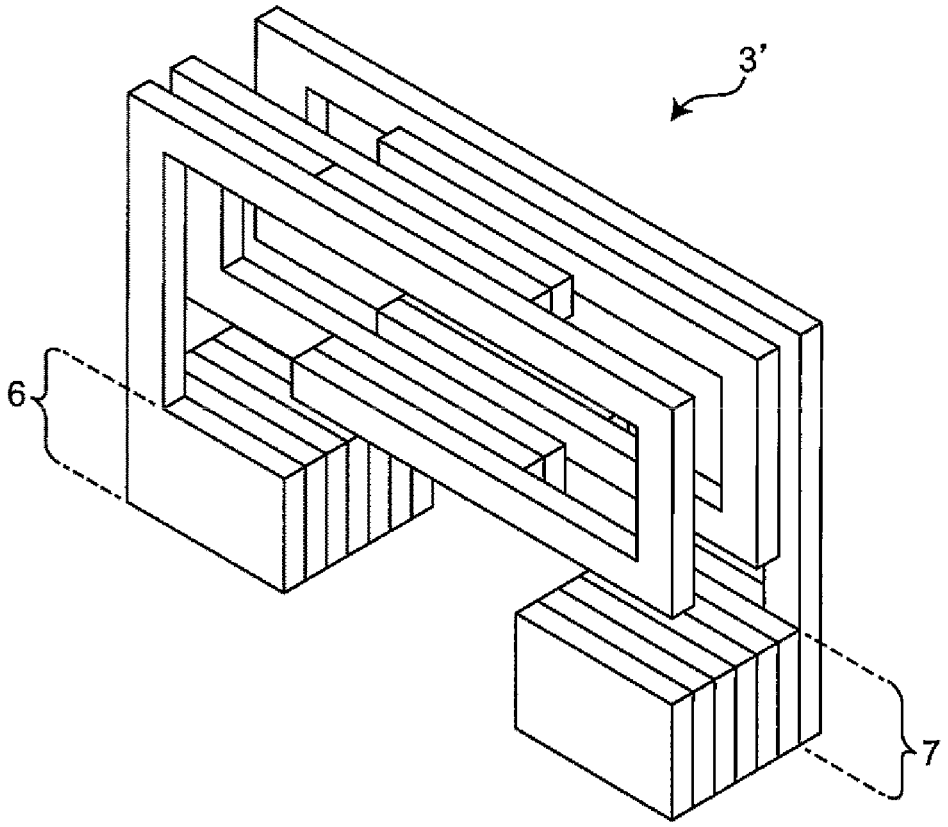
FIG. 9 is a perspective view of a coil portion of the coil component in the second embodiment.

In the same manner as the steps shown in FIGS. 7A and 7B, the conductor paste layer 44 is formed on the glass paste layer 42 by using the photolithography method (FIG. 7C), a glass paste layer 45 is further formed on the conductor paste layer 44, and a shape-retaining paste layer 46 is formed in the periphery of the glass paste layer 45 (FIG. 7D).

Subsequently, the steps from the step shown in FIG. 4E and thereafter are performed and, thereby, a coil component having the number of turns of 2.5 can be obtained.

Therefore, the present disclosure provides a method for manufacturing a coil component including an element assembly that contains a filler and a resin material, a coil portion composed of a coil conductor that is embedded in the element assembly, and a pair of outer electrodes electrically connected to the coil conductor, wherein the coil conductor is covered with a glass layer, the method including the steps of forming, on a substrate, a conductor paste layer of a photosensitive metal paste containing a metal that constitutes the coil conductor by using a photolithography method, forming a glass paste layer of a photosensitive glass paste containing glass that constitutes the glass layer by using a photolithography method so as to cover the conductor paste layer, forming a retaining layer of a photosensitive paste that can be removed after firing in regions, in which neither the conductor paste layer nor the glass paste layer is present, on the substrate, and forming a coil portion on the substrate by firing the substrate provided with the conductor paste layer, the glass paste layer, and the retaining layer.

According to a preferred aspect, the present disclosure provides the manufacturing method further including the steps of removing the substrate and providing the portion, from which the substrate has been removed, with an element assembly sheet.

The coil component and the method for manufacturing the coil component of the present disclosure are as described above. However, the present disclosure is not limited to the above-described embodiments, and the design can be changed within the scope of the gist of the present disclosure.

EXAMPLES

Production of Magnetic Sheet

An Fe—Si-based alloy powder having the D50 (particle diameter at cumulative percentage of 50% on a volume basis) of 5 μm was prepared. Regarding the alloy powder, about 50 nm of $SiO_2$ coating was formed on the powder surface in advance by a sol-gel method using tetraethyl orthosilicate (TEOS) as a metal alkoxide. A magnetic sheet was obtained by wet-mixing predetermined amounts of alloy powder and epoxy resin and forming the resulting mixture into a sheet (thickness of 100 μm) by a doctor blade method.

Production of Photosensitive Glass Paste

A borosilicate glass ($SiO_2$—$B_2O_3$—$K_2O$)-based glass powder having the D50 of 1 μm was prepared and mixed with a copolymer of methyl methacrylate and methacrylic acid (acrylic polymer), dipentaerythritol pentaacrylate (photosensitive monomer), dipropylene glycol monomethyl ether (solvent), 2,4-diethylthioxanthone, 2-methyl-1-[4-(methylthio)phenyl]-2-morpholinopropan-1-one, bis(2,4,6-trimethylbenzoyl)phenylphosphine oxide (photopolymerization initiator), and a dispersing agent so as to produce a photosensitive glass paste.

Photosensitive Conductor Paste

A Ag powder having the D50 of 2 μm was prepared and mixed with a copolymer of methyl methacrylate and methacrylic acid (acrylic polymer), dipentaerythritol pentaacrylate (photosensitive monomer), dipropylene glycol monomethyl ether (solvent), 2,4-diethylthioxanthone, 2-methyl-1-[4-(methylthio)phenyl]-2-morpholinopropan-1-one, bis(2,4,6-trimethylbenzoyl)phenylphosphine oxide (photopolymerization initiator), and a dispersing agent so as to produce a photosensitive conductor paste.

Shape-Retaining Photosensitive Paste

An alumina powder having the D50 of 10 μm was prepared and mixed with a copolymer of methyl methacrylate and methacrylic acid (acrylic polymer), dipentaerythritol pentaacrylate (photosensitive monomer), dipropylene glycol monomethyl ether (solvent), 2,4-diethylthioxanthone, 2-methyl-1-[4-(methylthio)phenyl]-2-morpholinopropan-1-one, bis(2,4,6-trimethylbenzoyl)phenylphosphine oxide (photopolymerization initiator), and a dispersing agent so as to produce a photosensitive alumina paste.

Production of Coil Component

A substrate (ceramic sintered substrate having a thickness of 0.5 mm or more) was prepared (FIG. 4A). The photosensitive glass paste was applied to the substrate by screen printing and dried. Thereafter, ultraviolet rays were applied through a mask so as to perform photo-curing. An uncured portion was removed by a tetramethyl ammonium hydroxide (TMAH) aqueous solution serving as a developing solution so as to form a glass paste layer having a predetermined form. Subsequently, a photosensitive alumina paste was applied by printing, exposed, and developed in the same manner so as to form an alumina layer in the periphery of the glass layer (FIG. 4B).

The photosensitive conductor paste was applied by printing, exposed, and developed in the above-described manner so as to form a conductor paste layer having a predetermined form (coil pattern 1) on the glass paste layer. The photosensitive glass paste was applied by coating, photo-cured through a mask, and developed so as to form a glass paste layer around the conductor layer (FIG. 4C). The photosensitive alumina paste was applied by coating and photo-cured through a mask so as to form an alumina layer in the periphery of the glass paste layer (FIG. 4C). This step was repeated five times so as to form the coil pattern 1.

The photosensitive glass paste was applied by coating, photo-cured through a mask, and developed so as to form a glass paste layer in a region except a connection portion conductor layer (FIG. 4D). The photosensitive alumina paste was applied by coating and photo-cured through a mask so as to form an alumina layer in the periphery of the glass paste layer (FIG. 4D).

The photosensitive conductor paste was applied by printing in the above-described manner, and exposed and developed in the above-described manner so as to form a conductor paste layer having a predetermined form (coil pattern 2) on the glass paste layer (FIG. 4E). This step was repeated five times so as to form the coil pattern 2.

The photosensitive glass paste was applied by coating, photo-cured through a mask, and developed in the above-described manner so as to form a glass paste layer in a region except a connection portion conductor layer (FIG. 4F).

A multilayer body composed of the conductor paste layers and the glass layers supported by the shape-retaining paste layers was obtained on the substrate by the above-described steps.

The multilayer body obtained as described above was fired at 700° C. The metal of the conductor paste layer and the glass of the glass paste layer sintered during the firing so as to become the coil conductor and the glass layer, respectively. Meanwhile, alumina of the shape-retaining paste layer did not sinter and remained as an unsintered alumina powder. The alumina powder was removed, and so a coil component supported by the substrate and the surface of which was covered with a glass layer was obtained (FIG. 5A).

Next, a magnetic sheet was placed on the side of the substrate provided with the coil portion, a die was used for holding, and the magnetic sheet was pressed into the coil portion by being pressurized by a press (FIG. 5B).

The substrate was removed by grinding (FIG. 5C).

Another magnetic sheet was placed on the surface, from which the substrate had been removed, a die was used for holding, and the magnetic sheet was made to come into close contact with the surface by being pressurized by a press (FIG. 5D).

Thereafter, cutting was performed by a dicer so as to separate the individual elements from each other.

An insulating layer was formed on the element surface by spraying an epoxy resin while shaking the resulting element and, thereafter, performing heat-curing.

The insulating layer was removed from regions, in which the outer electrodes were to be formed, of the element assembly by laser irradiation (FIG. 6A). Thereafter, outer electrodes were formed by sequentially depositing a Cu coating, a Ni coating, and a Sn coating on and above an exposed coil by electroplating.

In this manner, the coil component was obtained. The resulting coil component had a length (L) of 1.0 mm, a width (W) of 0.5 mm, and a height (T) of 0.5 mm. The thickness of the coil conductor was 100 μm, the width of the coil conductor was 120 μm, the width of the extension portion was 300 μm, and the thickness of the glass layer was 15 μm.

The coil component according to the present disclosure may be widely used for various applications, for example, an inductor.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

an element assembly that contains a filler and a resin material;

a coil portion composed of coil conductors that are embedded in the element assembly, and a coil axis of the coil portion being parallel to a mounting surface;

a pair of outer electrodes electrically connected to the coil portion, the outer electrodes being disposed on a lower surface; and glass layers, each of the glass layers is a separate component configured as a layer that is distinct from the filler and the resin material of the element assembly, at least partially surrounds a respective one of the coil conductors and is embedded in the element assembly, wherein adjacent ones of the coil conductors contact each other through an opening in one of the glass layers.

2. The coil component according to claim 1, wherein the coil portion has extension portions, and the extension portions extend from a winding portion of the coil portion toward the outer electrodes and are electrically connected to the outer electrodes.

3. The coil component according to claim 2, wherein the width of each of the extension portions is from 1.0 to 6.0 times the width of the winding portion.

4. The coil component according to claim 1, wherein the thickness of each of the coil conductors is from 3 μm to 200 μm.

5. The coil component according to claim 2, wherein the width of each of the extension portions is from 50 μm to 350 μm.

6. The coil component according to claim 1, wherein the coil conductors are covered with the glass layers.

7. The coil component according to claim 6, wherein the thickness of each of the glass layers is from 3 μm to 30 μm.

8. The coil component according to claim 1, wherein the length is from 0.3 mm to 2.2 mm, and the width is from 0.1 mm to 1.5 mm.

9. The coil component according to claim 2, wherein the thickness of each of the coil conductors is from 3 μm to 200 μm.

10. The coil component according to claim 3, wherein the thickness of each of the coil conductors is from 3 μm to 200 μm.

11. The coil component according to claim 3, wherein the width of each of the extension portions is from 50 μm to 350 μm.

12. The coil component according to claim 4, wherein the width of each of the extension portions is from 50 μm to 350 μm.

13. The coil component according to claim 2, wherein the coil conductors are covered with the glass layers.

14. The coil component according to claim 3, wherein the coil conductors are covered with the glass layers.

15. The coil component according to claim 4, wherein the coil conductors are covered with the glass layers.

16. The coil component according to claim 5, wherein the coil conductors are covered with the glass layers.

17. The coil component according to claim 2, wherein the length is from 0.3 mm to 2.2 mm, and the width is from 0.1 mm to 1.5 mm.

18. The coil component according to claim 3, wherein the length is from 0.3 mm to 2.2 mm, and the width is from 0.1 mm to 1.5 mm.

19. The coil component according to claim 4, wherein the length is from 0.3 mm to 2.2 mm, and the width is from 0.1 mm to 1.5 mm.

20. The coil component according to claim 5, wherein the length is from 0.3 mm to 2.2 mm, and the width is from 0.1 mm to 1.5 mm.

* * * * *